US012398012B2

(12) United States Patent
Miyazaki

(10) Patent No.: US 12,398,012 B2
(45) Date of Patent: Aug. 26, 2025

(54) SHEET POST-PROCESSING DEVICE AND IMAGE FORMING SYSTEM INCLUDING SAME

(71) Applicant: KYOCERA Document Solutions Inc., Osaka (JP)

(72) Inventor: Masahiko Miyazaki, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 18/403,359

(22) Filed: Jan. 3, 2024

(65) Prior Publication Data

US 2024/0228217 A1 Jul. 11, 2024

(30) Foreign Application Priority Data

Jan. 5, 2023 (JP) ..... 2023-000548

(51) Int. Cl.
*B65H 31/34* (2006.01)
*B65H 31/36* (2006.01)
*B65H 39/10* (2006.01)

(52) U.S. Cl.
CPC ..... *B65H 31/36* (2013.01); *B65H 39/10* (2013.01); *B65H 2404/1521* (2013.01); *B65H 2408/12* (2013.01); *B65H 2801/27* (2013.01)

(58) Field of Classification Search
CPC .... B65H 31/02; B65H 31/34; B65H 2801/27; B65H 37/04; B65H 2404/152; B65H 2404/1521; B65H 2408/114
USPC ..... 270/58.12, 58.17
See application file for complete search history.

(56) References Cited

U.S. PATENT DOCUMENTS 7,976,004 B2 * 7/2011 Kimura ..... B65H 31/3027 270/58.11
8,123,209 B2 * 2/2012 Kubota ..... B65H 31/36 270/58.08
8,172,214 B2 * 5/2012 Kubota ..... B65H 31/34 270/58.11
8,439,342 B2 * 5/2013 Okamoto ..... B65H 39/00 270/58.11
8,602,405 B2 * 12/2013 Okamoto ..... B65H 39/00 270/58.11

(Continued)

FOREIGN PATENT DOCUMENTS

JP 2006-256729 A 9/2006
JP 2020-033156 A 3/2020

*Primary Examiner* — Leslie A Nicholson, III
(74) *Attorney, Agent, or Firm* — Stein IP, LLC

(57) ABSTRACT

A sheet post-processing device includes a conveying member, a processing tray, a processing section, a reference plate, an alignment member, and a frame. The processing tray stacks sheets carried in by the conveying member. The alignment member moves the sheet carried in onto the processing tray in an alignment direction so as to aid alignment of the sheets. The alignment member includes a roller holder, an alignment roller, and a guide member. The guide member has a sheet guide part protruding from a swinging end of the roller holder to the downstream side in the alignment direction than the alignment roller. When the number of the sheets placed on the processing tray varies, an angle of the guide member with respect to the roller holder varies so that a distance between a top sheet placed on the processing tray and the sheet guide part becomes substantially constant.

5 Claims, 6 Drawing Sheets

(56) References Cited

U.S. PATENT DOCUMENTS

| | | | | |
|---|---|---|---|---|
| 8,874,022 | B2 * | 10/2014 | Kayaba | B65H 29/6618 271/220 |
| 9,016,681 | B2 * | 4/2015 | Mizubata | G03G 15/6552 270/58.11 |
| 10,941,013 | B2 * | 3/2021 | Egawa | B65H 31/02 |
| 2006/0208411 | A1 | 9/2006 | Saito et al. | 270/58.07 |
| 2020/0071116 | A1 | 3/2020 | Egawa | |

* cited by examiner

SHEET POST-PROCESSING DEVICE AND IMAGE FORMING SYSTEM INCLUDING SAME

INCORPORATION BY REFERENCE

This application is based upon and claims the benefit of priority from the corresponding Japanese Patent Application No. 2023-000548 filed Jan. 5, 2023, the entire contents of which are hereby incorporated by reference.

BACKGROUND

The present disclosure relates to a sheet post-processing device that performs predetermined post-processing on a sheet after image formation by an image forming apparatus, and to an image forming system including the same.

There is known a sheet post-processing device, which stacks a plurality of sheets after image formation by the image forming apparatus such as a copier or a printer, and performs a stapling process in which the stacked sheets are stapled as a whole by a stapler, a hole punching process in which punch holes (perforation holes) are formed in the sheets by a hole punching device, or a folding process in which a fold line is formed in the sheets.

This sheet post-processing device is equipped with a processing tray on which a predetermined number of sheets after image formation are placed. Then, the stapling process, a shift discharge process (sorting process), or the like is performed on the sheets placed on the processing tray. In addition, in order to smoothly perform the stapling process, the shift discharge process, or the like, the sheets on the processing tray are aligned using an alignment member such as an alignment roller.

SUMMARY

A sheet post-processing device according to one aspect of the present disclosure includes a conveying member, a processing tray, a processing section, a reference plate, an alignment member, and a frame. The conveying member conveys a sheet. The processing tray stacks a plurality of sheets conveyed in a predetermined carry-in direction by the conveying member. The processing section performs predetermined post-processing on the sheets placed on the processing tray. The reference plate abuts an edge of the sheet carried in onto the processing tray on a downstream side in an alignment direction opposite to the carry-in direction, so as to align the sheet in the carry-in direction. The alignment member moves the sheet carried in onto the processing tray in the alignment direction so as to aid alignment of the sheets. The frame supports the conveying member and the alignment member. The alignment member includes a roller holder, an alignment roller, and a guide member. The roller holder is disposed above the processing tray, and is supported by the frame in a swingable manner in the carry-in direction. The alignment roller is supported in a rotatable manner at a swinging end of the roller holder so as to contact with a top sheet placed on the processing tray. The guide member has a sheet guide part that protrudes toward the downstream side in the carry-in direction from the swinging end of the roller holder more than the alignment roller. The guide member is supported in a swingable manner at the swinging end of the roller holder. When the number of sheets placed on the processing tray varies, an angle of the guide member with respect to the roller holder varies so that a distance between the top sheet placed on the processing tray and the sheet guide part will be substantially constant.

DETAILED DESCRIPTION

Figure 1:
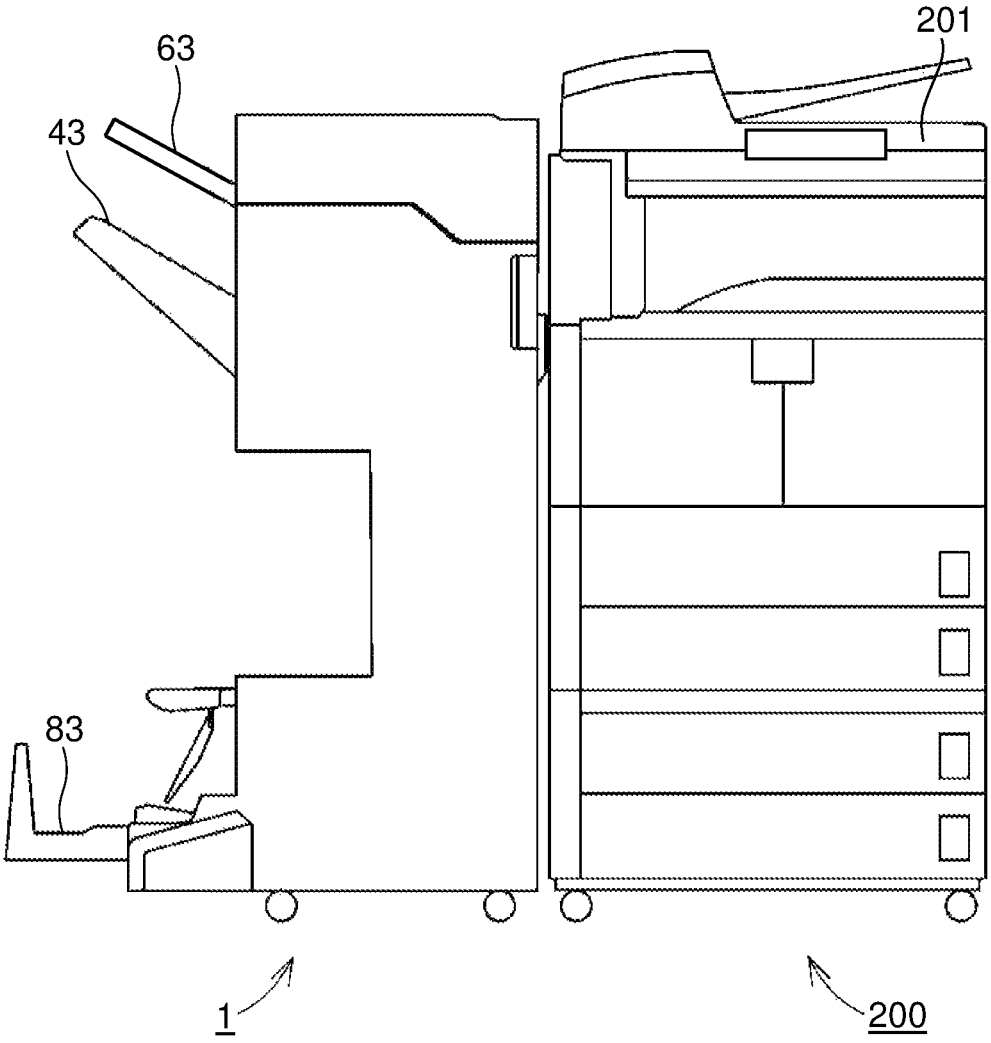
FIG. 1 is a schematic diagram illustrating a structure of an image forming system constituted of a sheet post-processing device according to an embodiment of the present disclosure, and an image forming apparatus to which the sheet post-processing device is connected.

Hereinafter, with reference to the drawings, an embodiment of the present disclosure is described in detail. FIG. 1 is a schematic diagram illustrating a structure of an image forming system constituted of a sheet post-processing device 1 including a sheet stapling unit 92 according to an embodiment of the present disclosure, and an image forming apparatus 200 to which the sheet post-processing device 1 is connected.

As illustrated in FIG. 1, the image forming apparatus 200 prints an image on a sheet (paper sheet), on the basis of image data input externally via a not-shown network communication unit, or image data read by an image reading unit 201 disposed at an upper part of the image forming apparatus 200.

The sheet post-processing device 1 is connected to a side face of the image forming apparatus 200 in an attachable and detachable manner. The sheet post-processing device 1 performs post-processing such as a hole punching process, a stapling process, or the like, on sheets after image formation (printing) by the image forming apparatus 200. Note that the sheet post-processing device 1 is not limited to one that performs the post-processing on the sheets conveyed automatically from the image forming apparatus 200, but may be one that conveys sheets set on a not-shown tray by a user to a position at which the post-processing can be performed, and performs the post-processing on the sheets.

Figure 2:
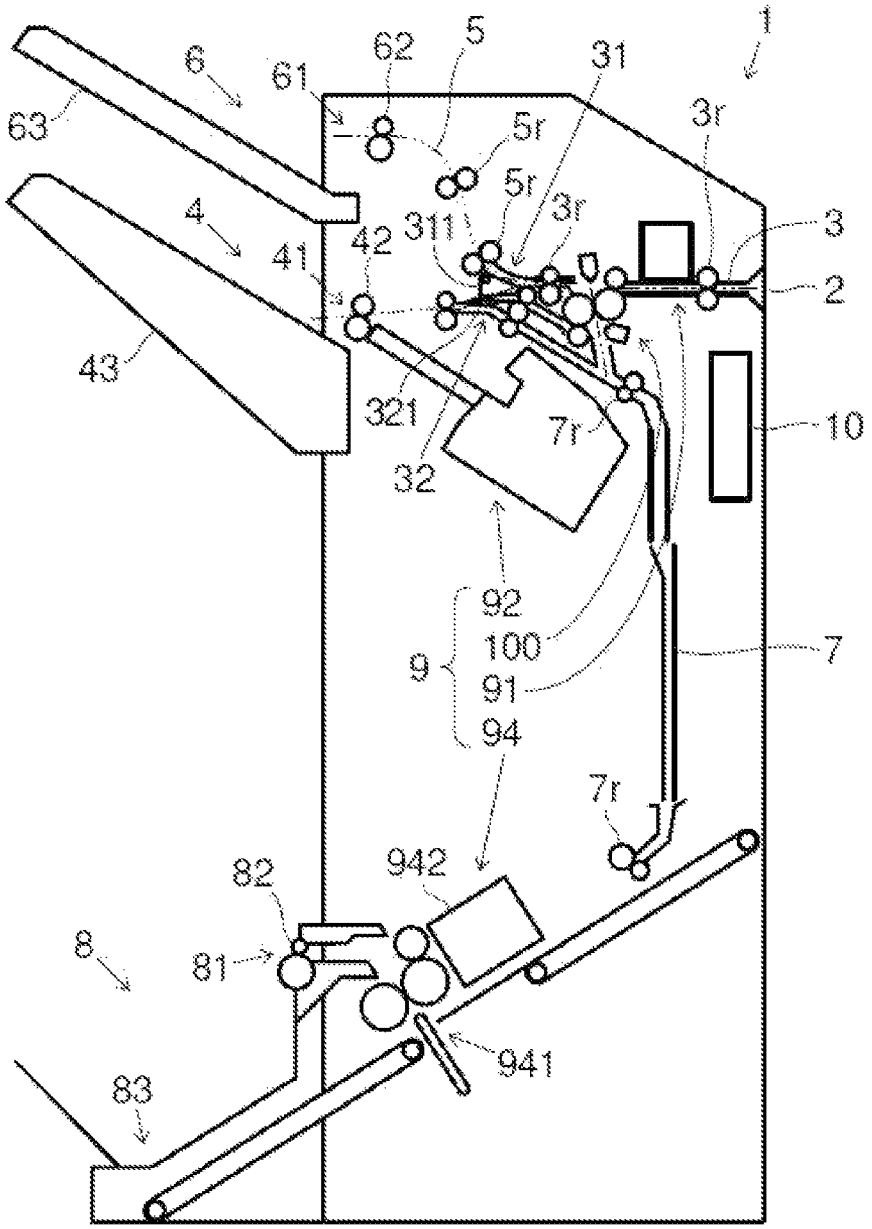
FIG. 2 is a cross-sectional side view schematically illustrating a structure of the sheet post-processing device of this embodiment.

FIG. 2 is a cross-sectional side view schematically illustrating a structure of the sheet post-processing device 1 of this embodiment. As illustrated in FIG. 2, the sheet post-processing device 1 includes a sheet carry-in entrance 2, a first sheet conveying path 3, a first sheet discharge unit 4, a second sheet conveying path 5, a second sheet discharge unit 6, a third sheet conveying path 7, a third sheet discharge unit 8, a post-processing unit 9, and a post-processing control unit (control unit) 10.

The sheet carry-in entrance 2 is an opening formed on the side face of the sheet post-processing device 1, which faces the image forming apparatus 200. The sheet conveyed from the image forming apparatus 200 to the sheet post-processing device 1 passes through the sheet carry-in entrance 2 and is carried into the sheet post-processing device 1.

The first sheet conveying path 3 extends in a substantially horizontal direction from the sheet carry-in entrance 2 to the first sheet discharge unit 4, in a direction separating from the image forming apparatus 200 (to the left direction in FIG. 2). Note that the direction from the sheet carry-in entrance 2 to the first sheet discharge unit 4 is referred to as a sheet conveying direction of the first sheet conveying path 3. The sheet carry-in entrance 2 is positioned at an upstream end of the first sheet conveying path 3 in the sheet conveying direction. The first sheet conveying path 3 includes a plurality of convey roller pairs 3*r*, and conveys the sheet carried in from the sheet carry-in entrance 2 to the sheet post-processing device 1, toward the downstream side in the sheet conveying direction.

The first sheet discharge unit 4 is disposed at a side face of the sheet post-processing device 1, which is opposite to the side face facing the image forming apparatus 200. The first sheet discharge unit 4 is disposed at a downstream end of the first sheet conveying path 3 in the sheet conveying direction. The first sheet discharge unit 4 includes a first discharge outlet 41, a first discharge roller pair 42, and a first discharge tray 43.

The first discharge outlet 41 is positioned at the downstream end of the first sheet conveying path 3 in the sheet conveying direction. The first discharge roller pair 42 is disposed at the first discharge outlet 41. The first discharge tray 43 is positioned on the downstream side of the first discharge outlet 41 in the sheet conveying direction. The sheet, which is conveyed along the first sheet conveying path 3 and reaches the first discharge outlet 41, is discharged onto the first discharge tray 43 by the first discharge roller pair 42 after passing through the first discharge outlet 41. The first discharge tray 43 is one of final discharge places of the sheets after post-processing by the sheet post-processing device 1.

The second sheet conveying path 5 branches from the first sheet conveying path 3 at a first junction (junction) 31 and extends laterally and upwardly to the second sheet discharge unit 6, in the direction separating from the image forming apparatus 200 (to the left direction in FIG. 2). The first junction 31 is disposed on the downstream side of a perforation unit 91 in the sheet conveying direction of the first sheet conveying path 3. Note that the direction from the first junction 31 to the second sheet discharge unit 6 is referred to as a sheet conveying direction of the second sheet conveying path 5. The first junction 31 is positioned at the upstream end of the second sheet conveying path 5 in the sheet conveying direction. The second sheet conveying path 5 includes a plurality of convey roller pairs 5*r*, and allows the sheet conveyed along the first sheet conveying path 3 to branch at the first junction 31, and conveys the sheet to the second sheet discharge unit 6.

The first junction 31 includes a first switching guide 311. The first switching guide 311 swings between a position for guiding the sheet, which is conveyed from the sheet carry-in entrance 2 along the first sheet conveying path 3, to the first discharge outlet 41 along the first sheet conveying path 3, and a position for guiding the sheet to the second sheet conveying path 5 after branching from the first sheet conveying path 3. Furthermore, the first switching guide 311 swings to a position for guiding the sheet, which passes through a later-described second folding conveying path 106 after a folding process, to the second sheet conveying path 5. The first switching guide 311 is connected to a drive mechanism (not shown), and its operation is controlled by a post-processing control unit 10.

The second sheet discharge unit 6 is disposed above the first sheet discharge unit 4 on the side face of the sheet post-processing device 1, which is opposite to the side face facing the image forming apparatus 200. The second sheet discharge unit 6 is disposed at the downstream end of the second sheet conveying path 5 in the sheet conveying direction. The second sheet discharge unit 6 includes a second discharge outlet 61, a second discharge roller pair 62, and a second discharge tray 63.

The second discharge outlet 61 is positioned at the downstream end of the second sheet conveying path 5 in the sheet conveying direction. The second discharge roller pair 62 is disposed at the second discharge outlet 61. The second discharge tray 63 is positioned on the downstream side of the second discharge outlet 61 in the sheet conveying direction. The sheet, which is conveyed along the second sheet conveying path 5 and reaches the second discharge outlet 61, is discharged onto the second discharge tray 63 by the second discharge roller pair 62 after passing through the second discharge outlet 61. The second discharge tray 63 is one of the final discharge places of the sheets after post-processing by the sheet post-processing device 1. In addition, sheets on which the post-processing is not performed, small size sheets, or the like are also discharged onto the second discharge tray 63.

The third sheet conveying path 7 branches from the first sheet conveying path 3 at a second junction 32, and extends downward to the third sheet discharge unit 8. Note that the direction from the second junction 32 to the third sheet discharge unit 8 is referred to as a sheet conveying direction of the third sheet conveying path 7. The second junction 32 is positioned on the downstream side of the first junction 31 in the sheet conveying direction of the first sheet conveying path 3, and is positioned at the upstream end of the third sheet conveying path 7 in the sheet conveying direction. The third sheet conveying path 7 includes a plurality of convey roller pairs 7*r*, allows the sheet conveyed along the first sheet conveying path 3 to branch at the second junction 32, and conveys the same to the third sheet discharge unit 8.

The second junction 32 includes a second switching guide 321. The second switching guide 321 swings between a position for guiding the sheet, which is conveyed from the sheet carry-in entrance 2 along the first sheet conveying path 3, to the first discharge outlet 41 along the first sheet conveying path 3, and a position for guiding the sheet, which is conveyed from the sheet carry-in entrance 2 along the first sheet conveying path 3 and is switched back after passing through the second junction 32, to the third sheet conveying path 7. The second switching guide 321 is connected to a drive mechanism (not shown), and its operation is controlled by the post-processing control unit 10.

The third sheet discharge unit 8 is disposed below the first sheet discharge unit 4 (near a lower end part of the sheet post-processing device 1), on the side face of the sheet post-processing device 1, which is opposite to the side face facing the image forming apparatus 200. The third sheet discharge unit 8 includes a third discharge outlet 81, a third discharge roller pair 82, and a third discharge tray 83.

The third discharge outlet 81 is positioned at the downstream end of the third sheet conveying path 7 in the sheet conveying direction. The third discharge roller pair 82 is disposed at the third discharge outlet 81. The third discharge tray 83 is positioned on the downstream side of the third discharge outlet 81 in the sheet conveying direction. The sheet, which is conveyed along the third sheet conveying path 7 and reaches the third discharge outlet 81, is discharged onto the third discharge tray 83 by the third discharge roller pair 82 after passing through the third discharge outlet 81. The third discharge tray 83 is one of the final discharge places of the sheets after post-processing by the sheet post-processing device 1.

The post-processing unit 9 performs predetermined post-processing on the sheets carried into the sheet post-processing device 1 after image formation by the image forming apparatus 200. The post-processing unit 9 includes the perforation unit 91, the sheet stapling unit 92, a sheet folding unit 100, and a binding unit 94.

The perforation unit 91 is disposed near the downstream side of the sheet carry-in entrance 2 of the first sheet conveying path 3. The perforation unit 91 performs a perforation process on the sheet conveyed along the first sheet conveying path 3, so as to form punch holes.

The sheet stapling unit 92 is disposed near the upstream side of the first sheet discharge unit 4 in the sheet conveying direction of the first sheet conveying path 3. The sheet stapling unit 92 performs the stapling process on a bundle of sheets formed by stacking a plurality of sheets, so as to staple the sheets. A detailed structure of the sheet stapling unit 92 will be described later.

The sheet folding unit 100 is disposed on the downstream side of the perforation unit 91 and the upstream side of the stapling unit 92, in the sheet conveying direction of the first sheet conveying path 3. The sheet folding unit 100 performs the folding process on one sheet so as to form a fold line. The sheet folding unit 100 can perform the folding process on one sheet, such as half-fold, Z-hold, outer three-fold, inner three-fold, or the like.

The binding unit 94 is disposed near the upstream side of the third sheet discharge unit 8 in the sheet conveying direction of the third sheet conveying path 7. The binding unit 94 includes a center-folding unit 941 and a center-stapling unit 942. The binding unit 94 performs a center-folding process and a center-stapling process for folding and stapling the substantial center of a bundle of sheets formed by stacking a plurality of sheets, in the sheet conveying direction, so as to make a booklet.

The post-processing control unit 10 includes a CPU, a storage unit, and other electronic circuits and components (which are not shown). The post-processing control unit 10 is connected to a main body control unit of the image forming apparatus 200 (see FIG. 1) in a communicable manner. The post-processing control unit 10 receives a command from the main body control unit, controls operations of individual components of the sheet post-processing device 1, and performs processing related to functions of the sheet post-processing device 1, using the CPU on the basis of control programs and data stored in the storage unit. The first sheet conveying path 3, the first sheet discharge unit 4, the second sheet conveying path 5, the second sheet discharge unit 6, the third sheet conveying path 7, the third sheet discharge unit 8, and the post-processing unit 9 each receive commands from the post-processing control unit 10 individually, and cooperate to perform post-processing on the sheet. Note that it may be possible that functions of the post-processing control unit (control unit) 10 are performed by the main body control unit of the image forming apparatus 200.

Figure 3:
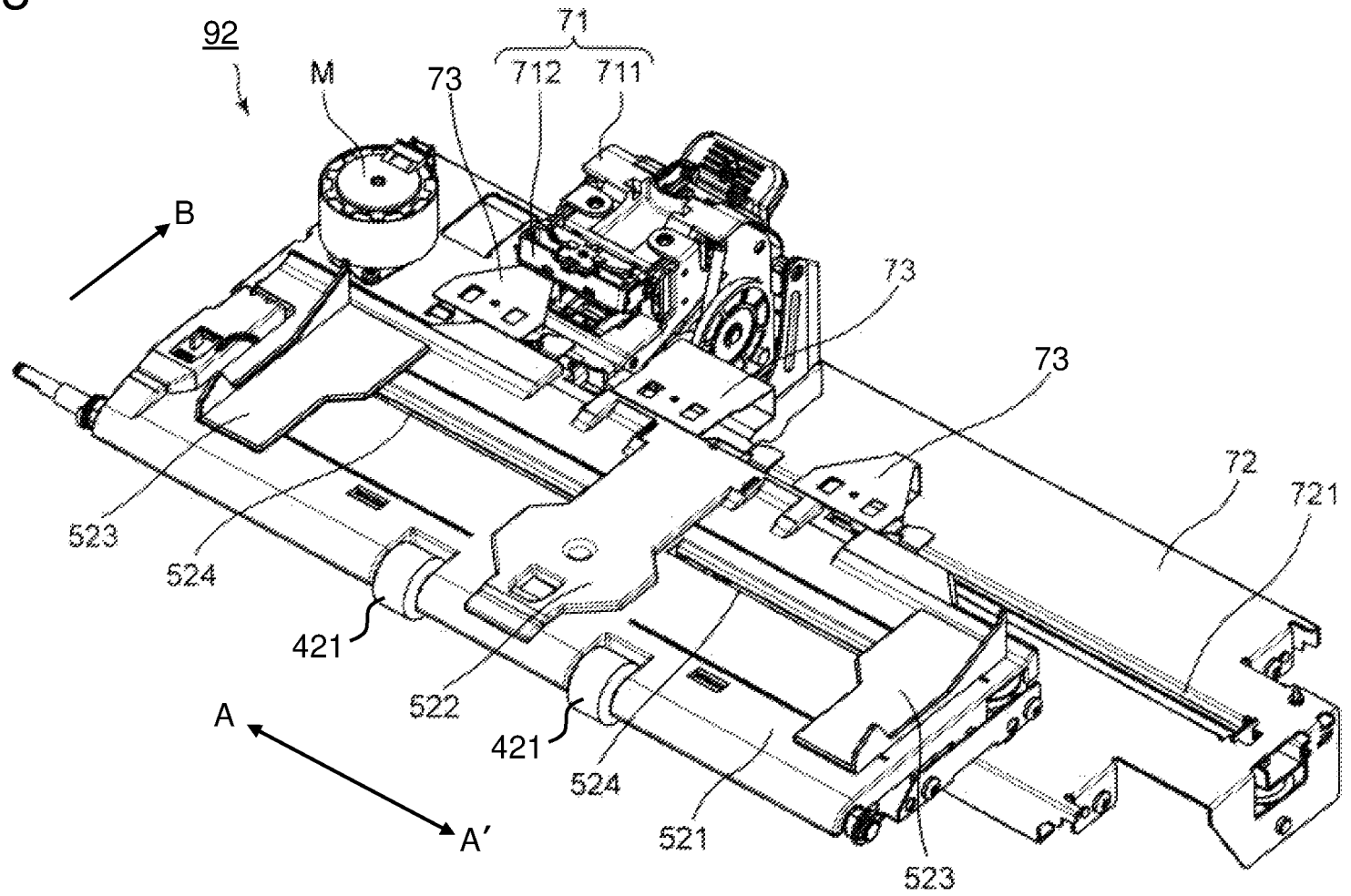
FIG. 3 is a perspective view of a sheet stapling unit mounted on the sheet post-processing device of this embodiment.
Figure 4:
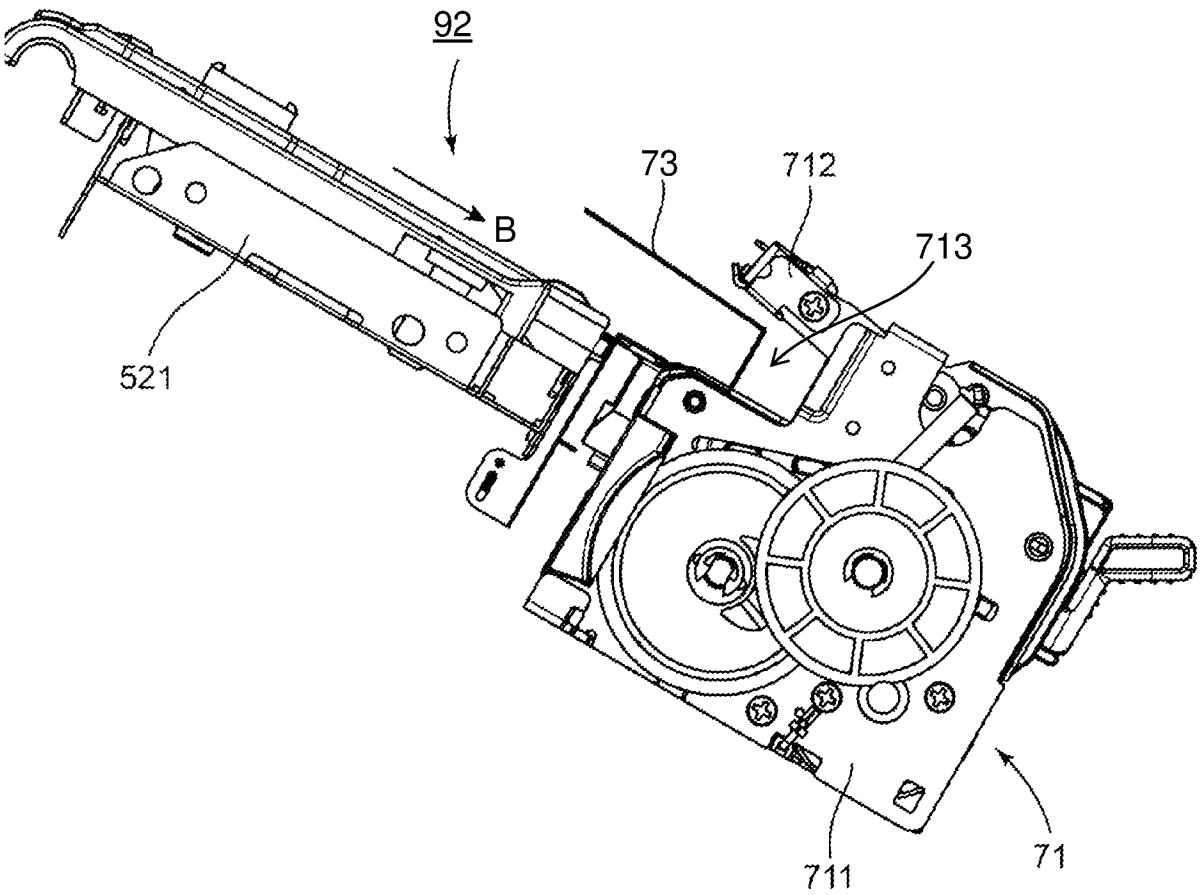
FIG. 4 is a side view of the sheet stapling unit.

Next, a structure of the sheet stapling unit 92 is described. FIG. 3 is a perspective view of the sheet stapling unit 92 mounted on the sheet post-processing device 1. FIG. 4 is a side view of the sheet stapling unit 92.

As illustrated in FIG. 3, the sheet stapling unit 92 includes a processing tray 521, a stapling unit 71, and a reference plate 73.

The processing tray 521 is a rectangular tray that extends in a sheet width direction (arrow AA' direction) and in a carry-in direction. A plurality of sheets S (the bundle of sheets) to be stapled are placed on the processing tray 521. In this case, the sheets S are carried in onto the processing tray 521 in the alignment direction toward the lower right direction in FIG. 4 (arrow B direction, opposite direction to the carry-in direction). The bundle of sheets after the stapling process is eventually sent out by the first discharge roller pair 42 (see FIG. 2) in the opposite direction to the above alignment direction (to the upper left direction in FIG. 4), and is discharged onto the first discharge tray 43 (see FIG. 2). The downstream side of the processing tray 521 in the carry-in direction (the lower left side in FIG. 3) supports a lower side roller 421 constituting the first discharge roller pair 42.

The processing tray 521 includes a tray middle part 522 and width restricting members 523. The tray middle part 522 is disposed on the top surface part of the processing tray 521 in the middle part in the sheet width direction. The tray middle part 522 is a sheet-like member fixed on the processing tray 521 with a slight height.

The width restricting members 523 are disposed in pair on both sides of the tray middle part 522 in the sheet width direction. The width restricting members 523 restrict a position in the sheet width direction of the sheet S carried in onto the processing tray 521. The width restricting member 523 is constituted of a sheet-like member similarly to the tray middle part 522, and has a sidewall standing upward at an end in the sheet width direction. The processing tray 521 is provided with a guide groove 524 formed to extend in the sheet width direction. The width restricting member 523 can be moved in a reciprocating manner along the guide groove 524 in the sheet width direction, by a drive mechanism such as a rack and pinion gear (not shown). In this embodiment, every time when the sheet is carried in onto the processing tray 521, the width restricting members 523 are driven by the drive mechanism to move in a reciprocating manner. As a result, the sheet placed on the processing tray 521 is aligned in the sheet width direction.

The stapling unit 71 is disposed so as to face an end edge of the sheet on the front end side in the alignment direction (the right side in FIG. 4). The stapling unit 71 can be moved by drive force of a motor M along the end edge of the sheet in the sheet width direction (arrow AA' direction) perpendicular to the carry-in direction, and performs the stapling process on the bundle of the sheets.

As illustrated in FIG. 4, the stapling unit 71 includes a staple main body part 711 and a staple movable part 712. The staple main body part 711 is a main body part of the stapling unit 71, in which a plurality of staple needles (not shown) are housed. The staple movable part 712 can move in the up and down direction, so as to insert the staple needle into the sheets S. Between the staple main body part 711 and the staple movable part 712, there is formed a recess 713 into which the end edge of the sheet enters.

The reference plates 73 are fixed at three positions separated in the sheet width direction, so as to face the end of the tray middle part 522 on the downstream side (the upper right side in FIG. 3 and the lower right side in FIG. 4) in the alignment direction. The reference plate 73 has a substantial U-shape that opens to the upstream side (the upper left side in FIG. 4) in the alignment direction, in a cross section perpendicular to the sheet width direction. The reference plate 73 abuts the end edge of the sheet carried in onto the processing tray 521, so as to align the sheet in the carry-in direction.

Figure 5:
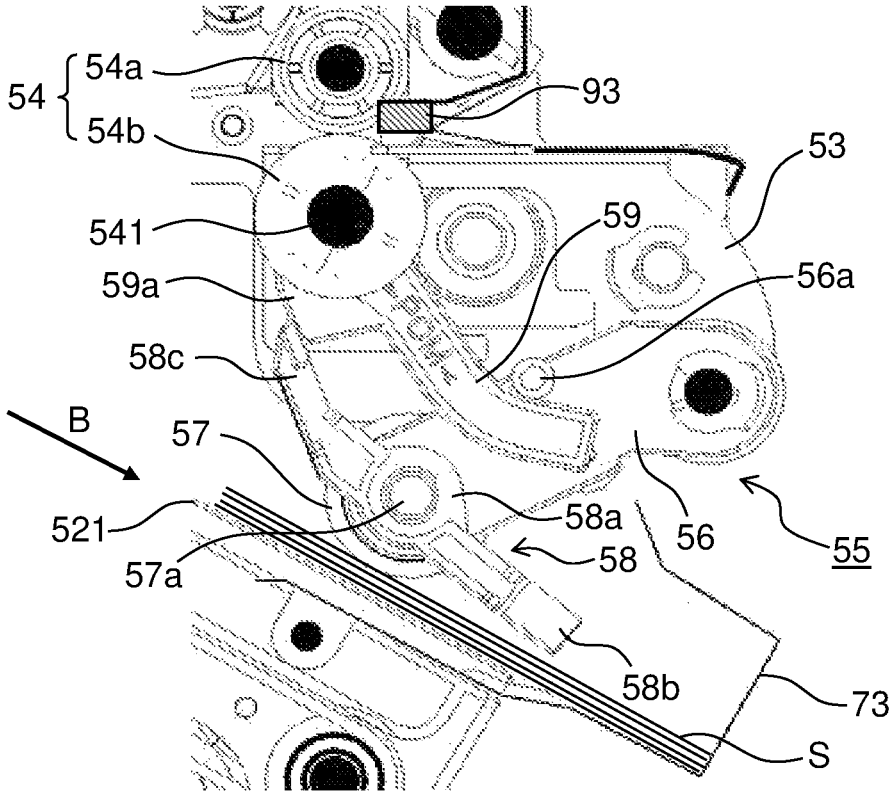
FIG. 5 is a cross-sectional side view illustrating a processing tray, an alignment member, and their vicinity.

FIG. 5 is a cross-sectional side view illustrating a structure of the processing tray 521, an alignment member 55, and their vicinity. As illustrated in FIG. 5, a carry-in roller pair 54 is provided to a conveyance frame 53 positioned above the processing tray 521. The carry-in roller pair 54 is constituted of an upper carry-in roller 54*a* and a lower carry-in roller 54*b*.

A sheet detection sensor 93 is disposed in a vicinity of the carry-in roller pair 54. The sheet detection sensor 93 detects timing when the sheet S passes the carry-in roller pair 54. As the sheet detection sensor 93, for example, a photo interrupter (PI) sensor is used, which includes a detection unit constituted of a light emitting part and a light receiving part.

The alignment member 55 is disposed below the carry-in roller pair 54. The alignment member 55 moves the sheet S carried in onto the processing tray 521 in the alignment direction to approach the reference plate 73, so as to aid the alignment of the sheet S. The alignment member 55 includes a roller holder 56, an alignment roller 57, and a guide member 58.

The roller holder 56 is supported by the conveyance frame 53 at the lower end part in a swingable manner along the carry-in direction of the sheet S. The alignment roller 57 is supported by the roller holder 56 at the swinging end in a rotatable manner. The alignment roller 57 is supplied with a rotation drive force from a drive source such as a motor (not shown), in a direction to send out the sheet S in the alignment direction (counterclockwise direction in FIG. 5). When the alignment roller 57 contacts with the upper surface of the sheet S carried in onto the processing tray 521, the sheet S is moved in the alignment direction (arrow B direction), and the end edge of the sheet S abuts the reference plate 73 for alignment.

The rotation drive of the alignment roller 57 is controlled based on detection timing of the sheet detection sensor 93. Specifically, the time is calculated in advance, which is from the timing when the sheet detection sensor 93 detects passing of the sheet S until the sheet S is carried in onto the processing tray 521 and is aligned by the reference plate 73. Then, the rotation drive of the alignment roller 57 is stopped at the timing when the above time elapses from the detection timing of the sheet S.

Alternatively, a roller having a small friction coefficient with the sheet S is used as the alignment roller 57, so that rotation of the alignment roller 57 may be continued after the sheet S is aligned by the reference plate 73. With this structure, after the sheet S abuts the reference plate 73, the alignment roller 57 idles (slips). Therefore, even if the friction coefficient of the sheet S varies due to a surface state of the sheet S or a moisture absorption state of the same, the sheet S can be securely aligned by abutting the reference plate 73.

The guide member 58 includes a fulcrum part 58*a* supported by a rotation shaft 57*a* of the alignment roller 57 in a swingable manner, a sheet guide part 58*b* extending from the fulcrum part 58*a* to the downstream side in the alignment direction of the sheet S (the lower right side in FIG. 5), and an angle adjusting part 58*c* extending to the upstream side in the alignment direction (the upper left side in FIG. 5). The sheet guide part 58*b* is disposed to face the sheet S carried in onto the processing tray 521 near the end edge on the downstream side in the alignment direction, so as to suppress uplift or bulge of the sheet S.

An arm member 59 is supported by a rotation shaft 541 of the lower carry-in roller 54*b* in a swingable manner. The arm member 59 receives a rotation drive force from a drive source such as a motor (not shown), in a forward direction (the counterclockwise direction in FIG. 5) and in a reverse direction (the clockwise direction in FIG. 5). An engagement boss 56*a* is formed on a side face of the roller holder 56. When the arm member 59 is swung in the forward direction, the arm member 59 contacts with the engagement boss 56*a* from below. When the arm member 59 is swung in the reverse direction, the arm member 59 separates from the engagement boss 56*a*.

The swinging of the arm member 59 is controlled based on the detection timing of the sheet detection sensor 93. Specifically, at the timing when the sheet detection sensor 93 detects passing of the sheet S, the arm member 59 is swung in the forward direction, and hence the arm member 59 contacts with the engagement boss 56*a* from below and lifts up the roller holder 56. As a result, the alignment roller 57 separates from the top surface of the processing tray 521 (or the sheet S placed on the processing tray 521).

Further, at the timing when the end edge of a new sheet carried in onto the processing tray 521 passes under the alignment roller 57, the arm member 59 is swung in the reverse direction. As a result, the arm member 59 separates from the engagement boss 56*a*, and hence the roller holder 56 swings downward by its weight, so that the alignment roller 57 contacts with the top surface of the sheet S. The operation described above is performed every time when the sheet S is carried in, and hence the alignment roller 57 can securely contact with the top surface of the sheet S, while avoiding interference between the alignment roller 57 and the end edge of the sheet carried in onto the processing tray 521.

The arm member 59 is provided with an arc-shaped sliding surface 59*a* formed near the rotation shaft 541. When the roller holder 56 swings upward (in the clockwise direction in FIG. 5), the angle adjusting part 58*c* of the guide member 58 contacts with the sliding surface 59*a*.

Figure 6:
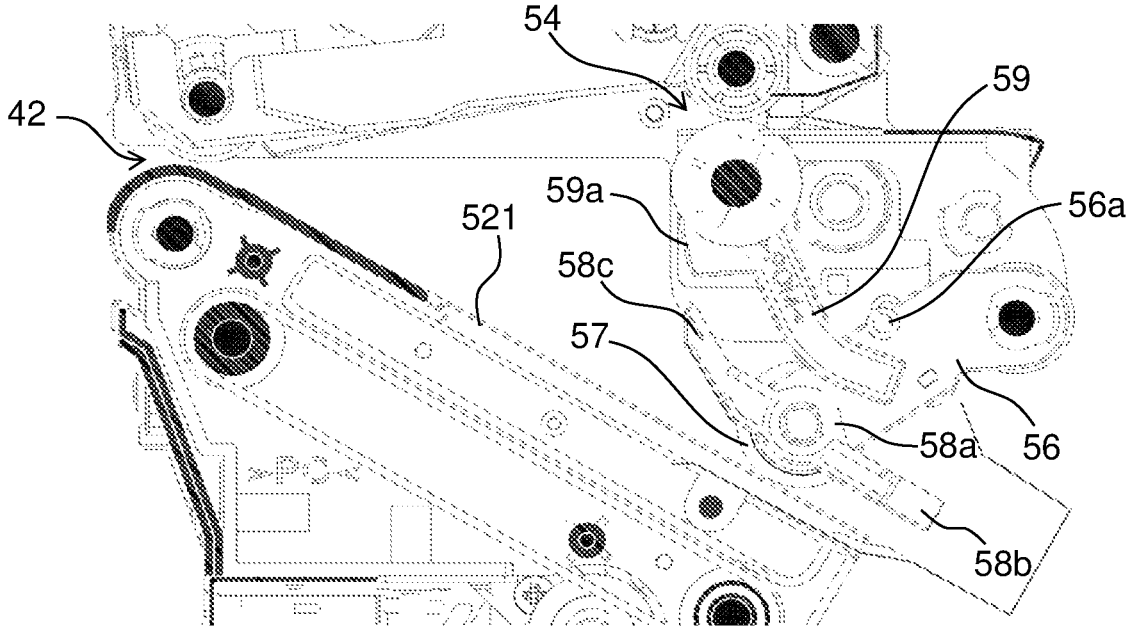
FIG. 6 is a cross-sectional side view illustrating the processing tray, the alignment member, and their vicinity, in a state where no sheet is carried in onto the processing tray

Next, there is described an operation of the alignment member 55 when the number of the sheets S carried in onto the processing tray 521 is increased. FIG. 6 is a cross-sectional side view illustrating a structure of the processing tray 521, the alignment member 55, and their vicinity, in a state where no sheet S is carried in onto the processing tray 521.

If no sheet S is carried in onto the processing tray 521, as illustrated in FIG. 6, the roller holder 56 is swung downward (in the counterclockwise direction in FIG. 6) by gravity acting on the roller holder 56 and the alignment roller 57, and the alignment roller 57 is contacted with the top surface of the processing tray 521.

The center of gravity of the guide member 58 is positioned closer to the sheet guide part 58*b* than the fulcrum part 58*a*. Therefore, in a state where no external force is applied to the guide member 58, the guide member 58 tends to swing in the direction for the sheet guide part 58*b* to descend by its weight (in the clockwise direction in FIG. 6). In addition, the roller holder 56 is provided with a restricting part (not shown) that restricts the swinging of the guide member 58 by its weight at a predetermined position. Therefore, as illustrated in FIG. 6, the guide member 58 is supported in a position where the sheet guide part 58*b* is substantially parallel to the processing tray 521. In this state, the angle adjusting part 58*c* of the guide member 58 is apart from the sliding surface 59*a*.

When the carry-in of the sheet S onto the processing tray 521 is started, the sheet S carried into the sheet post-processing device 1 from the sheet carry-in entrance 2 (see FIG. 2) passes through the first sheet conveying path 3 (see FIG. 2) and is carried in onto the processing tray 521 by the carry-in roller pair 54. In this case, the first discharge roller pair 42 is in a separate state (a nip released state), and the front end of the sheet S passes through the first discharge roller pair 42 and protrudes above the first discharge tray 43 (see FIG. 2). In addition, when the arm member 59 is swung in the forward direction, the roller holder 56 is lift up, and the alignment roller 57 is apart from the top surface of the processing tray 521.

At the timing when the rear end of the sheet S passes the carry-in roller pair 54, the post-processing control unit 10 (see FIG. 2) controls the arm member 59 to swing in the reverse direction. In this way, the roller holder 56 swing downward, and the alignment roller 57 contacts with the top surface of the sheet S. The sheet S is sent to the downstream side in the alignment direction by the alignment roller 57, so as to be aligned in the sheet width direction by the width restricting member 523 (see FIG. 3), and be aligned in the carry-in direction by the reference plate 73, and is stacked.

After a predetermined number of the sheets S are carried in onto the processing tray 521 and are aligned by the reference plate 73, the post-processing control unit 10 (see FIG. 2) controls the stapling unit 71 to perform the stapling process, controls the first discharge roller pair 42 to become a contact state (a nip formed state), and controls the first discharge roller pair 42 to rotate in a discharge direction. In this way, the bundle of sheets S is discharged onto the first discharge tray 43.

Figure 7:
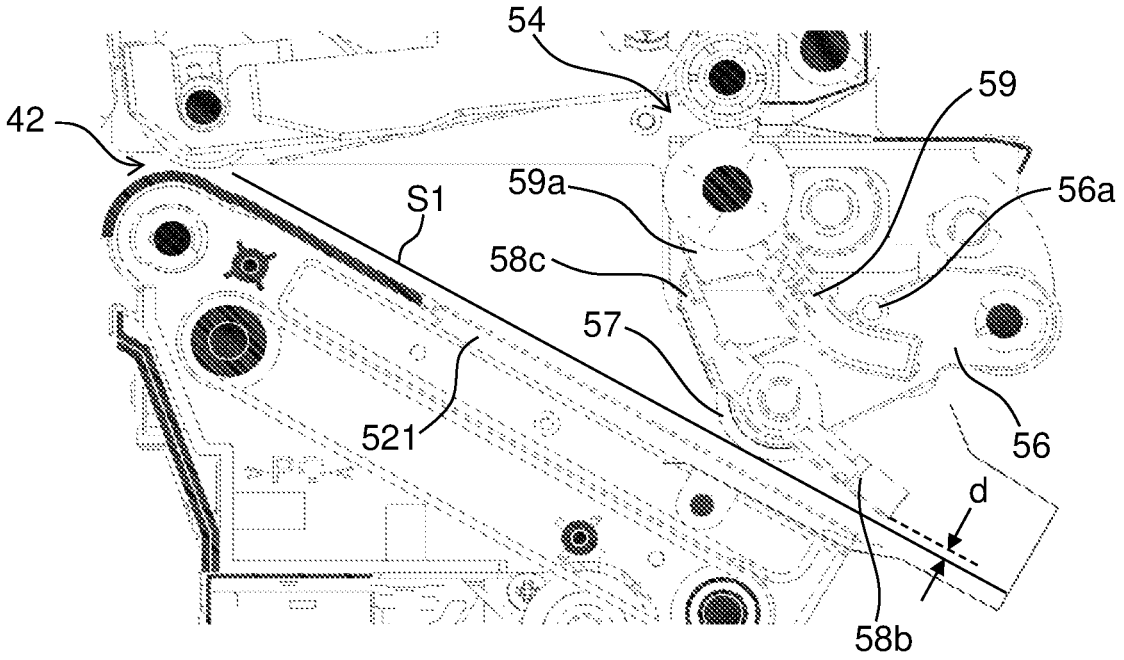
FIG. 7 is a diagram illustrating a state where a sheet is carried in onto the processing tray from the state illustrated in FIG. 6.

FIG. 7 is a diagram illustrating a state where the sheet S is carried in onto the processing tray 521 from the state illustrated in FIG. 6. When the sheet S is carried in onto the processing tray 521, the alignment roller 57 is lift up by the thickness of the sheet S. As a result, the roller holder 56 is also swung upward (in the clockwise direction in FIG. 7). When the roller holder 56 is swung upward, the angle adjusting part 58*c* of the guide member 58 contacts with the lower end part of the sliding surface 59*a*.

In this way, the guide member 58 slightly swings in the counterclockwise direction from the state illustrated in FIG. 6, and the sheet guide part 58*b* moves in the direction to separate from a top sheet S1. As a result, the guide member 58 is retained in a position where a predetermined distance d is secured between the sheet guide part 58*b* and the top sheet S1.

Figure 8:
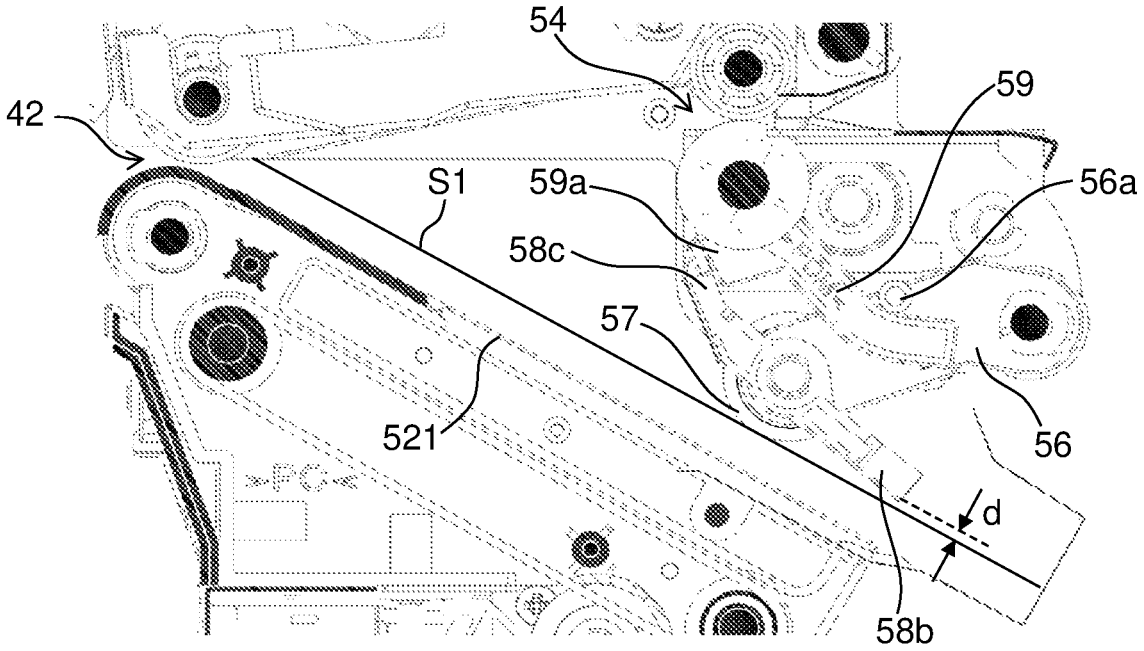
FIG. 8 is a diagram illustrating a state where another sheet is carried in onto the processing tray from the state illustrated in FIG. 7.

FIG. 8 is a diagram illustrating a state where another sheet S is carried in onto the processing tray 521 from the state illustrated in FIG. 7. When another sheet S is carried in onto the processing tray 521, the alignment roller 57 is further lift up by the thickness of the sheet S. As a result, the roller holder 56 also further swings upward (in the clockwise direction in FIG. 8).

When the roller holder 56 swings upward, the angle adjusting part 58*c* of the guide member 58 moves upward along the sliding surface 59*a*. In this case, the angle adjusting part 58*c* contacts with the sliding surface 59*a* and moves slightly in the direction to approach the processing tray 521 (in the clockwise direction in FIG. 8), and hence the sheet guide part 58*b* moves in the direction to separate from the processing tray 521.

The shape of the sliding surface 59*a* is designed so that a movement of the angle adjusting part 58*c* (the sheet guide part 58*b*) varies in accordance with variation of the upward swing angle of the roller holder 56, and that the distance d between the sheet guide part 58*b* and the top sheet S1 is maintained to be constant. Note that it may be possible that when the arm member 59 swings, an angle of the sliding surface 59*a* with respect to the top surface of the processing tray 521 varies, so that the distance d between the sheet guide part 58*b* and the top sheet S1 is maintained to be constant.

According to the structure described above, the guide member 58 swings in accordance with the number of the sheets S placed on the processing tray 521, and the distance d between the sheet guide part 58*b* and the top sheet S1 is maintained. Therefore, there is no risk that the sheet guide part 58*b* will contact with the top sheet S1 so as to disturb the alignment operation, or that the sheet guide part 58*b* will separate from the top sheet S1 so as to cause a variation in the effect of suppressing bulge of the sheet S. Therefore, the sheets S can be securely aligned in the state where a small number of the sheets S are placed on the processing tray 521, and in the state where the maximum allowable number of the sheets S are placed on the same.

In addition, when the roller holder 56 swings, the angle adjusting part 58*c* slides along the arc-shaped sliding surface 59*a* formed on the arm member 59, and hence the angle of the guide member 58 with respect to the roller holder 56 is changed. Therefore, without a complicated structure, the distance d between the sheet guide part 58*b* and the top sheet S1 can be maintained to be constant with a simple structure.

Although the embodiment of the present disclosure is described above, the scope of the present disclosure is not limited to this, but can be variously modified for implementation within the scope of the invention without deviating from the spirit thereof. For instance, in the embodiment described above, the case where the sheet stapling unit 92 performs the stapling process on the sheets S stacked on the processing tray 521 is exemplified, but without limiting to this, the present disclosure may have a structure in which a shift discharge process or the folding process is performed on the sheets S stacked on the processing tray 521.

In addition, in the embodiment described above, the sliding surface 59*a* is formed integrally to the arm member 59 in the vicinity of the swing fulcrum, but it may be possible to dispose a member having the sliding surface 59*a* separately from the arm member 59.

The present disclosure can be used for a sheet post-processing device that performs predetermined post-processing on a plurality of sheets.

What is claimed is:

1. A sheet post-processing device comprising:

a conveying member configured to convey a sheet;

a processing tray configured to stack a plurality of the sheets carried in by the conveying member in a predetermined carry-in direction;

a processing section configured to perform predetermined post-processing on the sheets placed on the processing tray;

a reference plate configured to abut an end edge of the sheet carried in onto the processing tray, on a downstream side in an alignment direction opposite to the carry-in direction, so as to align the sheet in the carry-in direction;

an alignment member configured to move the sheet carried in onto the processing tray in the alignment direction so as to aid alignment of the sheets; and a frame for supporting the conveying member and the alignment member, wherein the alignment member includes a roller holder disposed above the processing tray so as to be supported by the frame in a swingable manner in the carry-in direction, an alignment roller supported in a rotatable manner at a swinging end of the roller holder so as to contact with a top sheet placed on the processing tray, and a guide member having a sheet guide part protruding toward the downstream side in the alignment direction from the swinging end of the roller holder more than the alignment roller, the sheet guide part facing a top sheet among the sheets stacked on the processing tray across a predetermined distance therefrom, and the guide member is supported in a swingable manner at the swinging end of the roller holder, and when the number of the sheets placed on the processing tray varies, an angle of the guide member with respect to the roller holder varies so that a distance between the top sheet placed on the processing tray and the sheet guide part becomes substantially constant, the guide member further includes a fulcrum part supported in a swingable manner at the swinging end of the roller holder, and an angle adjusting part protruding from the fulcrum part to the upstream side in the alignment direction, the sheet guide part extends from the fulcrum part in the alignment direction, a sliding surface is provided, which is disposed to face the angle adjusting part and contacts with the angle adjusting part when the roller holder swings, so as to restrict the sheet guide part from swinging downward, and when the roller holder swings, the angle adjusting part slides along the sliding surface so that the angle of the guide member with respect to the roller holder varies.

2. The sheet post-processing device according to claim 1, further comprising a control unit configured to control swinging of the roller holder, wherein the control unit controls the roller holder to swing upward when the number of the sheets placed on the processing tray increases, and when the roller holder swings upward, the guide member swings about the fulcrum part in the direction where the sheet guide part separates from the processing tray.

3. The sheet post-processing device according to claim 1, further comprising an arm member whose one end is supported by the frame in a swingable manner, the arm member being configured to allow the roller holder to swing in the direction to separate from the processing tray when the sheet is carried in onto the processing tray, wherein the sliding surface is formed on one end of the arm member, and an angle of the sliding surface with respect to the top surface of the processing tray varies when the arm member swigs.

4. The sheet post-processing device according to claim 1, wherein the processing section is a stapling unit configured to perform a stapling process to staple the plurality of sheets placed on the processing tray with a staple needle at a predetermined position.

5. An image forming system comprising:

an image forming apparatus configured to form an image on a sheet; and the sheet post-processing device according to claim 1, configured to perform a predetermined post-processing on the sheet after image formation by the image forming apparatus.

* * * * *